US007185869B2

(12) United States Patent
Smith

(10) Patent No.: US 7,185,869 B2
(45) Date of Patent: Mar. 6, 2007

(54) FOLDABLE BOOK HOLDER

(76) Inventor: Ron Smith, 915 Imperial Way, Boise, ID (US) 83704

( * ) Notice: Subject to any disclaimer, the term of this patent is extended or adjusted under 35 U.S.C. 154(b) by 45 days.

(21) Appl. No.: 10/810,769

(22) Filed: Mar. 25, 2004

(65) Prior Publication Data

US 2004/0188588 A1 Sep. 30, 2004

Related U.S. Application Data

(60) Provisional application No. 60/458,052, filed on Mar. 25, 2003.

(51) Int. Cl.
*A47G 1/24* (2006.01)

(52) U.S. Cl. ..... 248/456; 248/460; 248/459; 40/539

(58) Field of Classification Search ..... 248/459, 248/460, 462, 463, 464, 441.1, 444.1, 456, 248/152, 174; 211/118, 42; 40/124.11, 120, 40/539, 152.1
See application file for complete search history.

(56) References Cited

U.S. PATENT DOCUMENTS

| | | | | |
|---|---|---|---|---|
| 631,520 | A * | 8/1899 | Dalsheimer | 248/459 |
| 1,594,848 | A * | 8/1926 | Partens | 248/174 |
| 2,005,816 | A * | 6/1935 | Weiss | 206/45.21 |
| 3,139,255 | A * | 6/1964 | Palm | 248/150 |
| 4,610,416 | A * | 9/1986 | Choi | 248/459 |
| 5,016,852 | A | 5/1991 | Herendeen | 248/461 |
| 5,029,798 | A | 7/1991 | Clark | 248/459 |
| 5,114,259 | A | 5/1992 | Meservy et al. | 402/80 R |
| 5,118,213 | A | 6/1992 | Meservy et al. | 402/80 R |
| 5,234,190 | A * | 8/1993 | Cross | 248/459 |
| 5,277,388 | A * | 1/1994 | Denaro | 248/152 |
| 5,456,440 | A | 10/1995 | Sideris | 248/458 |
| 5,492,299 | A | 2/1996 | Thermos et al. | 248/453 |
| 5,542,551 | A * | 8/1996 | Smith | 211/50 |
| 5,601,270 | A | 2/1997 | Chen | 248/454 |
| 5,660,117 | A | 8/1997 | Noble | 108/35 |
| 5,660,365 | A | 8/1997 | Glick | 248/459 |
| 5,755,423 | A | 5/1998 | Michela | 248/459 |
| 5,911,522 | A | 6/1999 | Wood | 40/124.09 |
| 5,941,496 | A * | 8/1999 | Banner | 248/459 |
| 6,213,439 | B1 | 4/2001 | Giulie et al. | 248/459 |
| 6,382,581 | B1 * | 5/2002 | Duff | 248/459 |
| 6,386,500 | B1 | 5/2002 | Dainoff et al. | 248/451 |

(Continued)

*Primary Examiner*—Amy J. Sterling
(74) *Attorney, Agent, or Firm*—Pedersen & Co., PLLC; Ken J. Pedersen; Barbara S. Pedersen

(57) ABSTRACT

A book stand folds flat, forming a single panel for storage or use as a clipboard, sketchpad, or straight edge. The book stand may also unfold into operational configuration to include an inclined supporting surface and a shelf, on which a book can rest at an inclined angle. The preferred legs or other support members extend from the rear side of the book stand near the left and right side edges of the book stand and diverge from each other to form a broad and stable base. The book stand may be set up in operational position with a minimum number of steps, by flipping up the shelf and pivoting the two legs on the backside of the book stand to swing underneath the shelf. In its folded, collapsed configuration, the preferred book stand may be a flat, substantially solid panel approximately 8.5"×11." The device can also be equipped with a magnification device, light, clip, page protector, or other visual aid devices.

16 Claims, 4 Drawing Sheets

U.S. PATENT DOCUMENTS 6,508,023 B2 * 1/2003 Moss et al. ..... 40/610
6,557,897 B1 5/2003 Gaudet ..... 281/33
6,581,895 B1 * 6/2003 Pleasant ..... 248/459
6,634,614 B1 10/2003 Page ..... 248/452
6,645,031 B2 11/2003 Rothkopf et al. ..... 446/73
6,672,549 B2 * 1/2004 Kolb ..... 248/127

* cited by examiner

FOLDABLE BOOK HOLDER

This application claims priority from U.S. Provisional Application Ser. No. 60/458,052, filed on Mar. 25, 2003, entitled "Foldable Book Holder," the disclosure of which is incorporated herein by this reference.

BACKGROUND OF THE INVENTION

1. Field of the Invention

The present invention relates generally to book stands, and more specifically to foldable book stands. The preferred embodiment more particularly relates to a foldable book stand, or book holder, with a shelf member and a pair of vertical support members that fold flush and 'snap' with the main body of the book stand and/or with the shelf, allowing the invention to be used not only as a book stand, but also as a writing board, sketch pad, straight edge, or clipboard. In its folded configuration, the invented book stand is compact in size so that it can be easily stored in a binder, brief case, back-pack, or other storage unit.

2. Related Art

It is well known that most readers place their reading material on a flat surface directly below their line of sight for ease of reading. At this angle, the reader is required to look downward for a prolonged amount of time, possibly causing eyestrain and/or discomfort in the neck. If the reader attempts to hold the reading material they will most likely suffer from additional fatigue in their hands and arms, furthermore hindering their ability to write and type.

As most people are aware there is a long-standing need for such a device as to be able to support a book or magazine at a comfortable reading level, be readily manufactured from inexpensive materials, and be transported easily by a wide variety of users (i.e. students, teachers, typists, and musicians).

There are numerous devices and methods employed in the prior art for the support of reading material. Even though many of these devices are designed for students and teachers and are intended to be lightweight and relatively foldable, most are too large and unmanageable for satisfactory storage and others require numerous steps to assemble. Some of these devices are complex arrangements that require excessive machining and are quite expensive to manufacture.

The present invention is lightweight, compact, aesthetically pleasing in its appearance, and more readily stored in a ring binder or folder than practically all the devices of the prior art. The preferred embodiments of the present invention may be set-up for use and folded for storage with a minimum of motions. The folded book stand may remain in a solid panel configuration of less than 3/16" thick to function favorably as a clipboard, sketchpad, or straight edge. In addition, the required components are few and simple to manufacture, easily fabricated from inexpensive materials, and can effectively support the weight of heavy books at a comfortable reading level. Some devices of the prior art that fold closed are not well-suited for use as a clipboard or sketchpad, and require excessive components, such as U.S. Pat. No. 5,941,496.

The preferred embodiments of the present invention include features such as a shelf member and a pair of vertical support members that preferably fold flush with the main body of the book stand. The advantage of a shelf member is its capacity to support a wide variety of books and magazines and also retain pages in a consistent position. Most devices of the prior art, such as U.S. Pat. No. 5,029,798, that include shelf elements are disadvantageous in the fact that they require numerous steps to assemble or are either too wide and/or too thick for satisfactory storage in a ring binder or folder.

Numerous devices of the prior art are not well-suited for additional adaptations such as a reading light, a book magnification device, clip, or other visual aid devices. The few devices that are adapted for such an apparatus are too bulky for transport. Three representative book stands that have been suggested in the art are those disclosed in U.S. Pat. No. 5,016,852, U.S. Pat. No. 5,456,440, and U.S. Pat. No. 5,660,117.

SUMMARY OF INVENTION

The present invention is a book stand for holding books, magazines, drawing pads, loose paper, or other objects for viewing at a non-horizontal position. Preferably, the book stand includes a generally rectangular panel with a plurality of support members attached to a rear surface and a shelf attached to a front surface. Preferably, the rectangular panel is about the size of an 8½"×11" piece of paper for easy storage in a binder, folder, backpack, or other storage unit. The preferred rectangular panel is not hinged, folded, or creased along its main body, therefore preventing it from easily bending or collapsing. The support members may be adapted to diverge from each other at their lower ends and at their rearward edges, creating a very stable support system.

The preferred rear surface of the rectangular panel has recesses of similar dimensions as the support members, for receiving the support members, and the shelf member may pivot to be coplanar with the panel. Preferably, when the support members are in the folded position, they 'snap' into the recesses or enter into some frictional engagement with the panel and/or shelf, preventing the support members from pivoting out of the recesses unless a user manually pivots the support members out of the recesses. Thus, the book stand may be adapted so that, when folded into a storage position, the support members, shelf, and panel are retained together and/or tend to stay together in a single flat unit, with both front and rear surfaces flat and parallel.

Preferably, the two support members pivot away from the midline into their set-up positions that are generally perpendicular to the rectangular surface, or more preferably, each slanting outward in the range of 90–120° to the rectangular panel. The preferred support members each have a hinge preferably angled about 5–25° from the outer edge of the rectangular panel. The preferred angle of the support members to the rectangular panel and the preferred hinge angle result in the support members being wide spread under the rectangular panel and, yet, still substantially vertical when the stand rests on a horizontal surface.

The preferred shelf is attached to or extends integrally from the bottom edge of the rectangular panel. Preferably, the shelf is the same length as the rectangular panel. Also, the shelf preferably pivots at a hinge towards the rectangular panel to a position generally perpendicular to the rectangular panel. Preferably, the shelf is supported on portions of the support members that extend forward and up. Preferably, tabs on the support members 'snap' into grooves or apertures in the shelf, holding the support members in the desired operative position.

An especially preferred embodiment has holes in the shelf and support members at distances suitable for placement of the book stand in a three or two ring binder. Also, the shelf may be contoured, so that when the book stand is in a ringed binder, it does not abut against the ring latches.

Therefore, the foldable book stand is easily kept in a folded position for easy storage in a binder, folder, backpack, or other storage unit. The simplicity of the design allows for easy manipulation of the parts into operative position. The angle and spacing of support members provides the greatest stability for holding a wide range of objects.

DETAILED DESCRIPTION OF THE INVENTION

Referring to the Figures, there are shown some, but not the only, embodiments of the present invention, which is referred to herein as a foldable book stand or book holder. The term "book" herein may include any type of a hard or soft cover book, magazine, binder, folder, loose paper, or other objects for viewing at a non-horizontal position.

Figure 1:
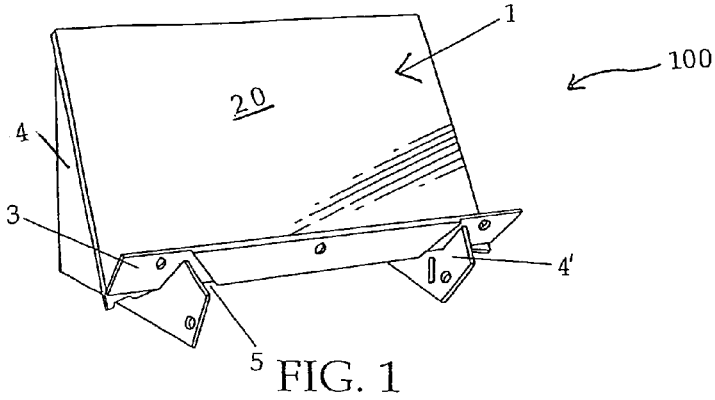
FIG. 1 is a view in perspective of one embodiment of the invented book holder showing the shelf member in its operative configuration.

In FIG. 1, a book stand 100 is shown in operational configuration, adapted to support a book at an inclined angle. Preferably, the book stand 100 is made of a lightweight, thin, rigid plastic, or other less preferred materials, such as aluminum, cardboard, particle board or other lightweight materials. In its preferred embodiment, the book stand 100 is comprised of two support members, three hinges, and two rectangular panels. Other embodiments may be adapted with additional components for various purposes.

The back of a book 15 is supported by a large rectangular panel 1, which comprises the main body of the book stand 100. The book 15 is supported along its bottom edge by means of a rectangular shelf 3 extending approximately 90° from rectangular panel 1, and extending the length of the bottom edge of rectangular panel 1.

Figure 3:
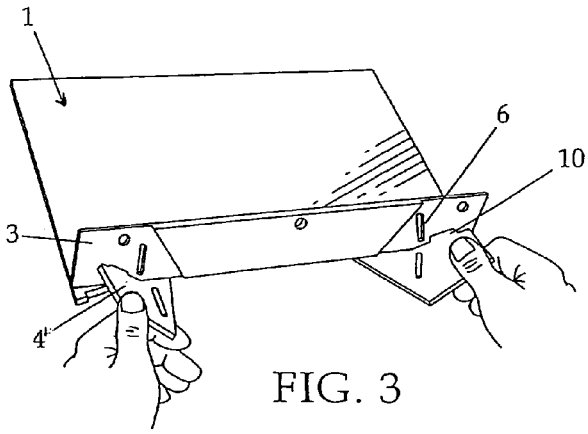
FIG. 3 is a perspective view of the book holder of FIGS. 1 and 2, wherein the two support members are shown being pivoted either into an operative configuration (wherein the front portions of the support members are being pivoted inward) or into a closed configuration (wherein the front portions of the support members are being pivoted outward).

A pair of generally vertical support members 4 protrude below the shelf member 3 and support the shelf member 3 in a stable operational configuration. As represented in FIG. 3, each support member 4 is preferably configured with a protruding tab 10 that engages with a rectangular notch or groove 6 in the shelf 3 for the purpose of maintaining the book stand 100 in an operational configuration by securing the shelf 3 relative to the two support members 4. The engagement of tabs 10 with notches/grooves 6 maintains the operative structure of the device, and is furthermore strengthened by the weight of a book. FIG. 3 illustrates how the user may grasp the front portions/extremities 4' of the support members 4 to pivot the support members 4 either inward (toward the midline of the book stand) to place the extremities 4' in position to engage with notches/grooves 6, or to pivot the support members 4 outward (away from the midline) to allow the support members 4 to pivot to the closed position parallel to the panel 1.

Figure 2:
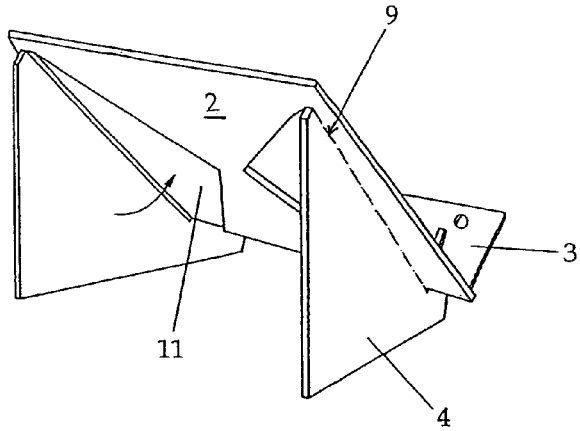
FIG. 2 is a rear view of the book holder of FIG. 1 showing two foldable support panels in an operative orientation.

A perspective rear view of the book stand 100 in an operative configuration is shown in FIG. 2, wherein support members 4 extend from the back surface 2 of the book stand 100 at slight angles to the back surface 2 and are affixed to the back surface 2 via a pair of flexible hinges 9. The hinges 9 allow the support members 4 to swing away from surface 2 to a vertical operational configuration. When the support members 4 are pivoted to an operational configuration, the front extremities 4' of the support members 4 extend underneath the shelf member 3 and are configured to support and interlock with said shelf member 3. The support members 4 support the weight of the book stand 100 and its contents and are capable of maintaining a heavy book 15 at an inclined angle.

The back surface 2 of the book stand 100 may be formed with a pair of recesses 11 preferably of similar dimensions as the support members 4. These recesses 11 may be triangular-shaped, curved, L-shaped, or any other shapes that effectively receive the support members 4. The indented recesses 11 are designed so that when the support members 4 are folded to a closed position, said support members 4 rest completely within the recesses 11, substantially coplanar and flush with the back surface 2.

Figure 4:
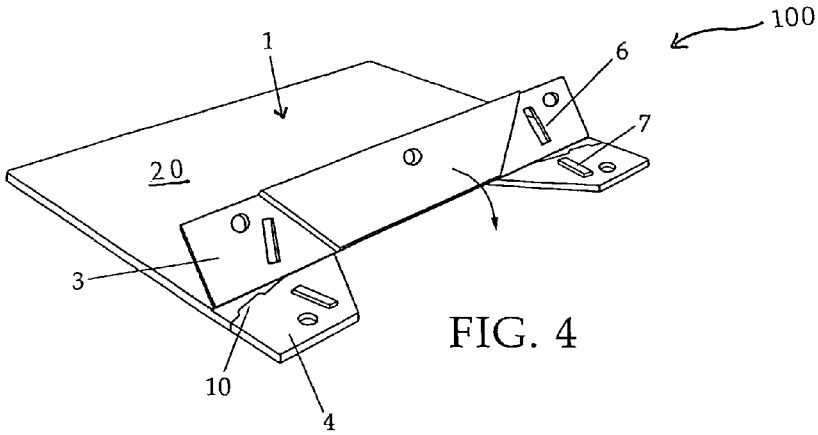
FIG. 4 is a view of the partially set-up book holder of FIGS. 1–3, wherein the shelf member is shown in a hyper-extended position

Now referring to FIG. 4, a partially closed book stand 100 is depicted wherein the pair of support members 4 are parallel with the front surface 20 of the book stand 100. Each support member 4 may be configured with a rectangular retaining snap 7 of substantially the same size as the rectangular notch 6. The two retaining snaps 7 are adapted to engage with said notches 6 that can be formed on the shelf member 3. When the shelf member 3 is swung towards a closed configuration, the retaining snaps 7 and the notches 6 engage and snap together.

Figure 5:
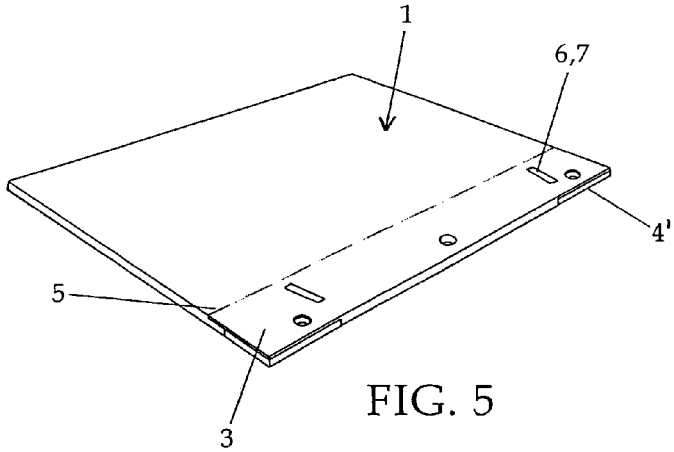
FIG. 5 is a perspective view of the book holder of FIGS. 1–4 in its folded configuration.

When the book stand 100 is in the closed configuration, as illustrated in FIG. 5, the shelf member 3 is closed and coplanar with panel 1, and is essentially locked into position via the pair of retaining snaps 7 and pair of notches 6. The shelf member 3 holds the support members 4 in a flat position and the entire embodiment remains in a folded configuration, because the shelf 3 and both support members 4 are restrained from pivoting on their respective axes. In this folded configuration the flexible hinge 5 and also flexible hinges 9, due to their being integral, flexible portions of the panel 1 and/or shelf 3 material, are relatively flat and smooth and form a favorable writing surface with optimum aesthetic appeal.

To construct the book stand 100 from its closed configuration back to an open configuration, the shelf member 3 is first disengaged from said retaining snaps 7 and pivoted (FIG. 4) perpendicular to surface 20. The front extremities 4' of the support members 4 are then rotated inwardly (see FIG. 3) in one continuous motion until the tabs 10 engage with the notches 6. When the notches 6 and tabs 10 are engaged the book stand 100 maintains a sturdy operational configuration as depicted in FIGS. 1 and 2.

AN ESPECIALLY PREFERRED EMBODIMENT

Figure 8:
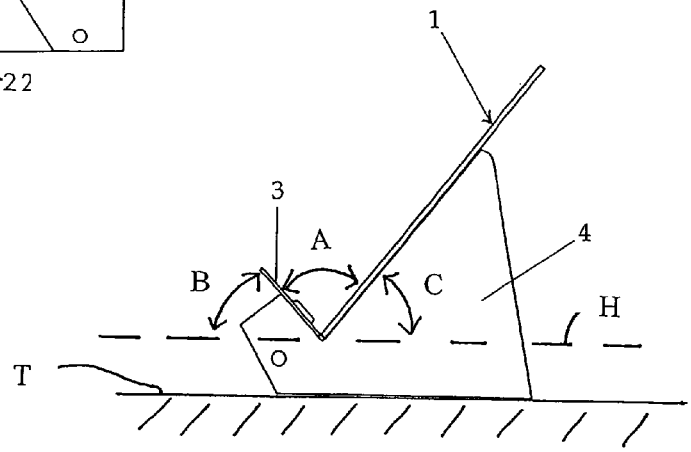
FIG. 8 is a side plan view of the book holder of FIGS. 1–7 in its operative configuration.
Figure 11:
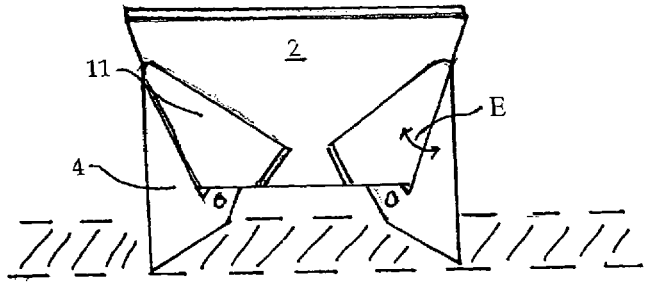
FIG. 11 is a rear view of the embodiment of FIGS. 1–9, showing to best advantage an especially preferred embodiment of the support member configuration.
Figure 12:
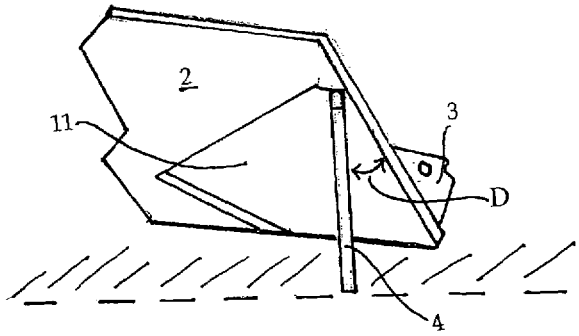
FIG. 12 is a partial rear perspective view of the especially preferred embodiment of FIG. 11.

In an especially preferred support system for the book stand 100, shown to best advantage in FIGS. 8, 11 and 12, the support members are distanced from each other and slanted, so as to produce a broad, stable base that resists tipping or other movement when torque is applied to one end or another of the book stand 100. In FIG. 8, the shelf member 3 is adjoined to rectangular panel 1 via a horizontal hinge 5, by which hinge, the shelf member 3 can be swung towards the front surface 20 of rectangular panel 1, to be at angle A relative to panel 1. Preferably, shelf member 3 is slanted upwards at an angle B relative to the plane of the table T (and relative to horizontal plane H in FIG. 8) that allows the shelf to retain the book 15 against the rectangular panel 1 and prevent the book 15 from sliding off the shelf 3. For example, in the embodiment in FIG. 8, the shelf angle B is about 45° relative to the plane of the table. Alternatively, the inventor envisions that shelves in the range of about 25–60° relative to the plane of the table T will be most effective and convenient. Preferably panel 1 is at an angle of about 40–70° to the plane of the table (angle C in FIG. 8), so that the book 15 is held in a generally upright position that is comfortable for the reader. Therefore, depending on the angles selected for angles B and C, the resulting angle A would be between about 50–115°, but preferably is in the range of 70–110°.

Figure 7:
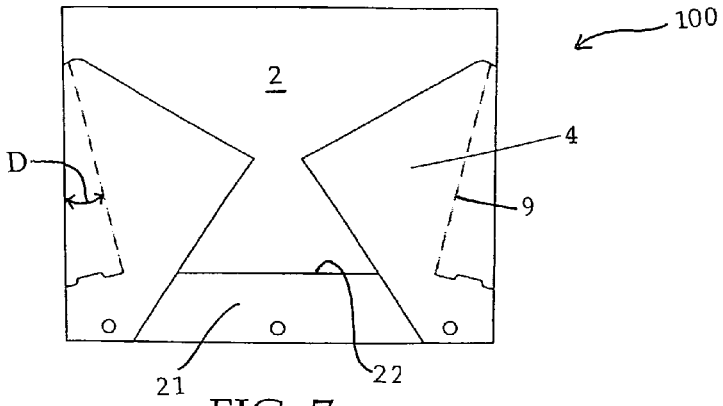
FIG. 7 is a rear view of the book holder of FIGS. 1–6 in its folded configuration.

FIGS. 11 and 12 are rear views of book stand 100, illustrating how support members 4 preferably diverge from each other on the back surface 2 of the book stand 100 in operational configuration. Preferably, the support members 4 diverge from each other by means of angle E being 100–130° and preferably about 110°. The pair of support members 4 are adjoined to the rear surface of the rectangular panel 1 via hinges 9 preferably angled about 5–25° from the edge of the panel 1 (angle D in FIGS. 7 and 12). As shown in FIG. 7 to best advantage, the longitudinal axis of each hinge 9, which is the pivot axis of the respective support member, is at an angle to the respective outer side edge of the panel 1. Preferably, the top ends of the support members 4 are closer to the respective panel 1 edges than the bottom ends of the support members 4. The hinges 9 are preferably located no more than 2" away from the said panel edge 1 for an 11" long panel 1. Also, as shown in FIGS. 11 and 12, the support members 4 are generally vertical, so that the weight of the book 15 is carried with little or no horizontal force component applied to the support members 4 to pivot the support members 4 out from under the book stand 100. Positioning both the hinges 9 and the support members 4 away from the book stand 100 midline and close to the panel 1 side edges, distributes the force of a book on the book stand 100 over a greater distance creating a very broad and stable support base.

Figure 10:
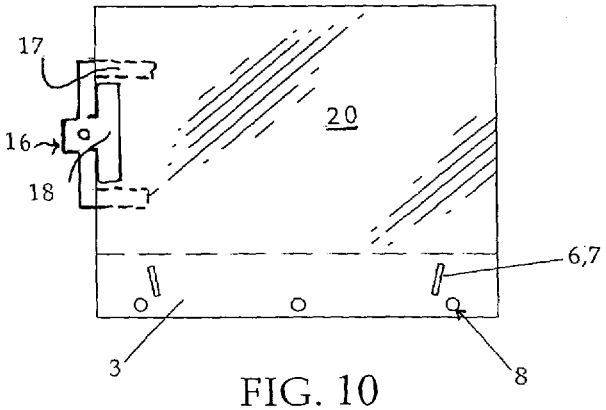
FIG. 10 is a front view of an alternative embodiment, wherein a clip is inserted in the main body of the book holder.

Optionally, the book stand 100 may also accommodate a clipping device 16 that can be fastened directly to the sketchpad so as to function as a clipboard (see FIG. 10). As shown in FIG. 10, the book stand 100 may be designed to have holes in the panel 1 for receiving the clipping device legs 17. These holes could be in a side edge or a top edge of the panel 1 depending on whether the reader wishes to use the book holder as a clipboard or to hold a book 15. The clip 18 extends over the front surface 20 of the book stand 100 in order to attach to the top of a soft cover book or to retain pages that have a tendency to close.

Figure 6:
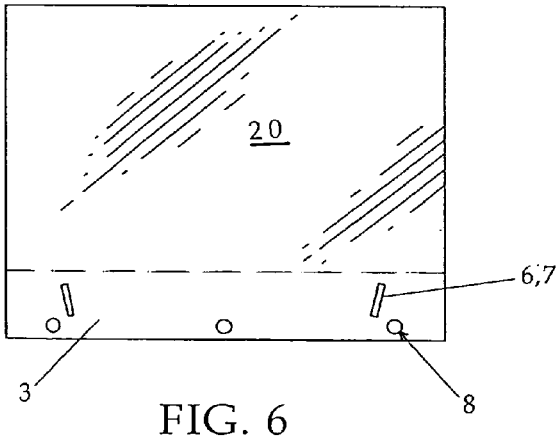
FIG. 6 is a front view of the book holder of FIGS. 1–5 in its folded configuration.
Figure 9:
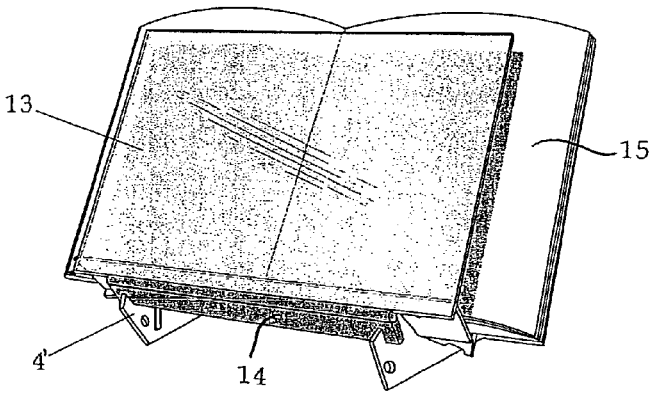
FIG. 9 is a perspective view of the book holder of FIGS. 1–8 supporting a transparent cover and book.

For ease of transport the present invention may also be configured with holes 8, depicted in FIG. 6, for storage in a ring binder. As illustrated in FIG. 9, the book stand 100 may also be configured to accommodate additional adaptations such as a reading light, book magnification device, page retainer, or transparent page protector 13, which may be connected to the book stand 100 by a hinged bar 14 or other fastener. This hinged bar 14 may, for example, be received in slots provided in the front extremities 4' of the support members 4. These or other slots or fasteners may be provided on the front extremities 4' or on other portions of the stand to receive, for example, a reading light that is non-obstructive to the view of the reader, a reading magnification device such as a thin, flexible lens preferably configured within a structural frame, a cleanable transparent cover to protect the reading material from spills and splattering of liquids and/or for the use with dry-erase markers, and/or a holder for a ruler or straight edge.

Preferably, the panel 1 is unhinged, uncreased, and smooth in surface. Preferably, when the book stand 100 is in the folded configuration, the entire unit is no more than 8–10"×11–12". The components of the book stand 100 can be fabricated by injecting plastic into a mold, stamping rectangular stock, or other methods. While the preferred method of manufacture is to plastics-mold the stand 100, the book stand 100 also may be made by a two-panel stamping or cutting process, for example, including the following steps:

provide two flat rectangular panels of the same dimensions;

on the first (rear) panel: cut the appropriate edges and score the hinges 9 for the support members 4, score a bottom central portion 21 of the panel between the support members 4 at line 22 (in this manufacturing method, this portion 21 attach to and pivots with the shelf 3), and provide snaps 7;

on the second (front) panel: score the shelf hinge and cut the grooves/notches 6; and, adhere the two panels together at the appropriate places by adhesive, sonic welding, or other means (the support members 4 are not adhered to the second panel and the shelf 3 is not adhered to the first panel except it may be adhered to the bottom central portion 21 of the first panel which pivots with the shelf 3).

The tabs 10, notches/grooves 6, and snaps 7 may be shapes other than those shown, preferably but not necessarily with tabs 10 extending from an edge surface of extremities 4' and with snaps 7 extending Also, other securing systems besides tabs 10 and grooves 6 may be used for securing the support members 4 to the shelf 3 and/or relative to the panel 1. For example, fasteners, clips, fold-out tabs, or other systems to prevent movement of the support members 4 when in the operative configuration. Likewise, other securing systems besides the snaps 7 and grooves 6 for holding the shelf 3 and the support members 4 in the folded configuration may be used, for example, fasteners, clips, lock and key devices, preferably as long as said securing systems do not significantly protrude beyond the planes of the front and back surfaces so that they do not interfere with use of the book stand 100 in the folded configuration. Note, also, that the two preferred securing systems (for securing the support members 4 in operation configuration and for securing the support members 4, shelf 3, and panel 1, in folded storage configuration) share elements, so that the total number and complexity of elements is minimized. Notches/grooves 6 are common to both securing systems.

While the panel 1 and the shelf are preferably rectangular and the support members 4 are preferably generally triangular, other shapes may be used and the edges of these elements also may be curved or rounded as desired for various aesthetic tastes. The term "support member," therefore, in this Description and in the claims does not limit those members to the particular shape drawn, but may be other legs or extending members within the broad scope of the claims.

Although this invention has been described above with reference to particular means, materials and embodiments, it is to be understood that the invention is not limited to these disclosed particulars, but extends instead to all equivalents within the broad scope of this disclosure and the following claims.

I claim:

1. A foldable reading stand for supporting a book or other object, the stand having a flat collapsed configuration for storage, and a set-up configuration for holding an object in an inclined position, said stand comprising:

a panel having a front surface for holding an object in an inclined position, a rear surface, and right and left side outer edges;

a shelf connected to said panel and pivotal to a flat position parallel to said panel, when the stand is in said flat collapsed configuration, and to a set-up position at an angle to the front surface of the panel, when the stand is in said set-up configuration, wherein the shelf in the set-up position is adapted to support said object in the inclined position on the panel; and right and left support members connected to the rear surface of the panel near said right and left side outer edges, respectively, the right and left support members being pivotal on a first pivot axis and a second pivot axis, respectively, to fold flat against said panel when the stand is in the flat collapsed configuration, and to pivot away from each other, when the stand is in the set-up configuration, to extend rearward from the panel and diverge from each other to support the panel in an inclined position, and wherein front portions of the right and left support members extend underneath the shelf to hold the shelf in said set-up position;

wherein said shelf comprises a right groove and a left groove, and wherein said front portion of the right support member comprises a first tab frictionally received in said right groove to secure the right support member to the shelf, when the shelf is in the set-up position and the stand is in the set-up configuration, and wherein said front portion of the right support member further has a second tab frictionally received in said right groove to secure the shelf to the right support member and retain the shelf parallel to the right support member, when the shelf is in a collapsed position and the stand is in the flat collapsed configuration.

2. The stand of claim 1, wherein said right and left support members are vertical when the stand is in the set-up configuration.

3. The stand of claim 1, wherein said front portion of the left support member comprises a first tab frictionally received in said left groove to secure the left support members to the shelf, when the shelf is in the set-up position and the stand is in the set-up configuration, and wherein said front portion of the left support member further has a second tab frictionally received in said left groove to secure the shelf to the left support member and retain the shelf parallel to the left support member, when the shelf is in the collapsed position and the stand is in the flat collapsed configuration.

4. The stand as in claim 1, wherein the rear surface of the panel comprises right and left recesses that receive said right and left support members, respectively, when the stand is in the flat collapsed configuration.

5. The stand as in claim 1, further comprising a visual aid selected from the group consisting of: reading light, a reading magnification device, a transparent cover, and a holder for a ruler or straight edge.

6. The stand as in claim 1 that has a rectangular outer perimeter when in the flat collapsed configuration.

7. A foldable reading stand for supporting a book or other object, the stand having a flat collapsed storage configuration as a flat panel and an set-up configuration for displaying an object in an inclined position, said stand comprising:

a panel having a front surface for receiving an object, a rear surface, and right and left side outer edges;

a shelf connected to said panel and pivotal to a collapsed position parallel to said panel and to a set-up position at an angle to the front surface of the panel, wherein the shelf in the set-up position is adapted to support said object in an inclined position on the panel;

right and left support members pivotally connected to the rear surface of the panel near the right and left side outer edges, and adapted so that, when the stand is in said set-up configuration, the right and left support members extend rearward from the panel to support the panel in an inclined position and wherein front portions of the right and left support members extend underneath the shelf to hold the shelf in said set-up position, wherein each of said right and left support members comprises an edge protrusion extending from an edge of its respective front portion and a surface protrusion extending from a side surface of its respective front portion;

wherein said shelf comprises a right notch and a left notch, said right notch frictionally receiving the edge protrusion of the right support member in the set-up position and frictionally receiving the surface protrusion of the right support member in the collapsed position, so that the right support members and shelf are secured to each other when the stand is in both said flat collapsed storage configuration and said set-up configurations.

8. The stand of claim 7, wherein said right and left support members are pivotally attached to the rear surface of the panel, said right support member pivoting on a right pivot axis that is at an angle relative to said right side outer edge, and said left support member pivoting on a left pivot axis that is an angle to said left side outer edge.

9. The stand of claim 8, wherein said right and left support members are vertical when the stand is in the set-up configuration.

10. The stand of claim 8, wherein said right pivot axis is at an angle of 5–25 degrees from said right side outer edge and said left pivot axis is at an angle of 5–25 degrees from said left side outer edge.

11. The stand as in claim 7, wherein the rear surface of the panel comprises right and left recesses that receive said right and left support members, respectively, when to stand is in the flat collapsed storage configuration.

12. The stand as in claim 7, further comprising a visual aid selected from the group consisting of: a reading light, a reading magnification device, a transparent cover, and a holder for a ruler or straight edge.

13. The stand as in claim 7 that has a rectangular outer perimeter when in the flat collapsed configuration.

14. A foldable stand for supporting a book or other object, the stand having a flat collapsed configuration for storage, and a set-up configuration for holding an object in an inclined position, said stand comprising:

a panel having a front surface for holding an object in an inclined position, a rear surface, and right and left side outer edges;

a shelf connected to said panel and pivotal to a flat position parallel to said panel, when the stand is in said flat collapsed configuration, and pivotal to a set-up position at an angle to the front surface of the panel, when the stand is in said set-up configuration, wherein the shelf in the set-up position is adapted to support said object in the inclined position on the panel; and right and left support members connected to the rear surface of the panel near said right and left side outer edges, respectively, the right and left support members being pivotal to fold flat against said panel, when the stand is in the flat collapsed configuration, and to pivot away from each other, when the stand is in the set-up configuration, to extend rearward from the panel and diverge from each other to support the panel in an inclined position, and wherein front portions of the right and left support members extend underneath the shelf to hold the shelf in said set-up position; and, wherein, when the stand is in the flat collapsed configuration, a portion of each of the right and left support members contacts and is parallel to the shelf in the collapsed position;

wherein said shelf has a right hole and a left hole, said right support member has a hole and said left support member has a hole, and wherein, when the stand is in the flat collapsed configuration, the right hole of the shelf is aligned with the hole of the right support member and the left hole of the shelf is aligned with the hole of the left support member, said holes being aligned for receiving the rings of a binder whereby the stand is stored in the binder.

15. The stand of claim 14, wherein said shelf has a center hole between said right hole and said left hole for storing said stand in a three-ring binder.

16. The stand of claim 14, wherein said shelf comprises a snap connection to said right and left support members, so that, when the stand is in the flat collapsed configuration, the shelf is secured to, and parallel with, said right and left support members.

* * * * *